US007927224B1

(12) United States Patent
Ferguson et al.

(10) Patent No.: US 7,927,224 B1
(45) Date of Patent: Apr. 19, 2011

(54) GOLF CLUB TRAINING DEVICE

(76) Inventors: Bob J. Ferguson, Eloy, AZ (US); Toby S. Farrow, Casa Grande, AZ (US); Daniel J. T. Nowlin, Casa Grande, AZ (US)

( * ) Notice: Subject to any disclaimer, the term of this patent is extended or adjusted under 35 U.S.C. 154(b) by 0 days.

(21) Appl. No.: 12/661,577

(22) Filed: Mar. 18, 2010

Related U.S. Application Data

(60) Provisional application No. 61/215,533, filed on May 5, 2009.

(51) Int. Cl.
*A63B 69/36* (2006.01)

(52) U.S. Cl. ..... 473/138; 473/226; 473/235

(58) Field of Classification Search ..... 473/138, 473/139, 142, 143, 145, 146, 147, 149, 226, 473/235, 286, 296, 423, 424, 430, 431
See application file for complete search history.

(56) References Cited

U.S. PATENT DOCUMENTS

| | | | | | |
|---|---|---|---|---|---|
| 1,960,110 | A | * | 5/1934 | Iles | 473/286 |
| 2,057,821 | A | * | 10/1936 | Costello | 473/235 |
| 2,094,766 | A | * | 10/1937 | Costello | 473/138 |
| 2,107,983 | A | * | 2/1938 | Hamilton | 473/296 |
| 2,597,704 | A | * | 5/1952 | Carlson | 156/245 |
| 3,065,563 | A | * | 11/1962 | Bascom | 43/19 |
| 4,145,051 | A | | 3/1979 | Krumholz | |
| 4,384,719 | A | * | 5/1983 | Schmanski | 473/138 |
| 4,526,374 | A | | 7/1985 | Ban | |
| 5,249,810 | A | | 10/1993 | Cazalet | |
| 5,662,527 | A | * | 9/1997 | Jacquinot et al. | 473/138 |
| 5,725,441 | A | * | 3/1998 | Jensen et al. | 473/251 |
| D537,483 | S | | 2/2007 | Kort et al. | |
| 2006/0258474 | A1 | | 11/2006 | Gruenke | |

* cited by examiner

*Primary Examiner* — Nini Legesse
(74) *Attorney, Agent, or Firm* — Gregory J. Nelson

(57) ABSTRACT

A training device for practicing and learning the technique of juggling or repeatedly tapping a golf ball off the face of a golf club. The device has a lofted club head to which is tethered a resilient ball. A ball receptacle, either a semi-spherical cup or a pair of arcuate arms may be provided on the toe of the head to retrieve or receive a ball. A lip on the sole facilitates retrieval of a ball to begin or resume practice.

5 Claims, 2 Drawing Sheets

200
214
226
228
250
254
225
232
242
240
236
50
275
234
270
238

18
12
16
14

10
14
26
28
52
54
25
32
36
40
42
38
34
50

20
11
12
18
111
114
100
163
160
126
128
125
132
138
136
150
142
134
140
152

GOLF CLUB TRAINING DEVICE

CROSS-REFERENCE IS MADE TO RELATED APPLICATION

This application is based on U.S. Provisional Patent Application Ser. No. 61/215,533, filed May 5, 2009, of the same title.

FIELD OF THE INVENTION

The present invention relates to a golf club training device and more particularly to a golf club training device for practicing and learning the technique of juggling and repeatedly tapping a golf ball off the face of a golf club head.

BACKGROUND OF THE INVENTION

The technique of juggling or tapping a golf ball on the face of a golf club head has been popularized by Tiger Woods. The technique involves juggling or tapping a golf ball on the face of a golf club head repeatedly and requires eye-hand coordination, agility and concentration. The technique is made difficult by the fact that the club head face has a relatively small, hard surface and the ball has compression characteristics which make it rebound off the club head surface. Even a slight error or mispositioning of the golf club by the individual may result in the ball rebounding from the golf club head surface to a position from which it may be hard to recover and continue the bouncing or juggling without interruption. Generally individuals learn or acquire the necessary skills using a conventional golf club and a conventional golf ball.

Generally the technique involves gripping the golf club with the dominant hand on the shaft near the lower end of the shaft adjacent the hosel. The individual will then hold the ball over the club face and drop the ball on the face attempting to bounce the ball up and down several times keeping the club face directly under the ball. As indicated, the technique requires skill and proper timing. As an individual practices and becomes more proficient, the individual is able to bounce the ball a number of times off the face of the club head. The individual may then move his or her hand further up the shaft towards the grip, continuing the juggling and/or bouncing practice until this trick can be performed holding the club at the grip end. While practicing, the face of the club should be maintained in a horizontal position.

As the individual becomes more skilled or proficient of the technique, the individual may learn to stop the ball on the face of the club head and may also learn to juggle using various clubs.

The above learning technique is time-consuming and difficult using a conventional golf club. Further, when the golf ball rebounds off the face of the club head and is not properly re-struck, the ball will have to be retrieved by the user and the practice session resumed.

BRIEF SUMMARY OF THE INVENTION

Briefly, the present invention provides a training device for teaching the skills necessary to allow a user to become proficient in repeatedly tapping or bouncing a golf ball off the face of a golf club head.

One embodiment of the present invention provides a golf club having a golf club head configured similarly to a conventional wedge having a loft of 56° or more. The shaft has upper and lower sections. The upper section carries a grip and the upper and lower sections are adjustable relative to one another to vary the overall length of the shaft.

The practice ball is a softer ball such as a ball of rubber or a wiffle-type ball not having the compression characteristics of a conventional golf ball, being more resilient. The ball is tethered to the golf club by a cord or string extending through the face of the golf club head and adjustable at the rear of the club shaft or by attachment to a sleeve slidable along the lower shaft section.

In another embodiment, the device, again, has a golf club head having a high loft attached to a shaft. The toe of the golf club head is formed having an integral ball receptacle such as a cup in which the ball can be placed to initiate the practice routine.

In another embodiment, the ball receptacle comprises a pair arcuate arms extending from the toe of the club. The arcuate arms may be used to cradle the ball when beginning the practice. The arms also will assist the golfer in retrieving or picking up the ball from a surface. The sole of the golf club also has an extending lip which may be used to engage the golf ball and transfer it onto the face of the club to begin the practice routine.

BRIEF DESCRIPTION OF THE DRAWINGS

The above and other advantages and objects of the present invention will become more apparent when taken in conjunction with the following description, claims and drawings in which:

DETAILED DESCRIPTION OF THE DRAWINGS

The present invention relates to a training device for practicing the skills necessary to tap or juggle a golf ball repeatedly on the face of a golf club head.

Figures 1, 1A, 2, 3:
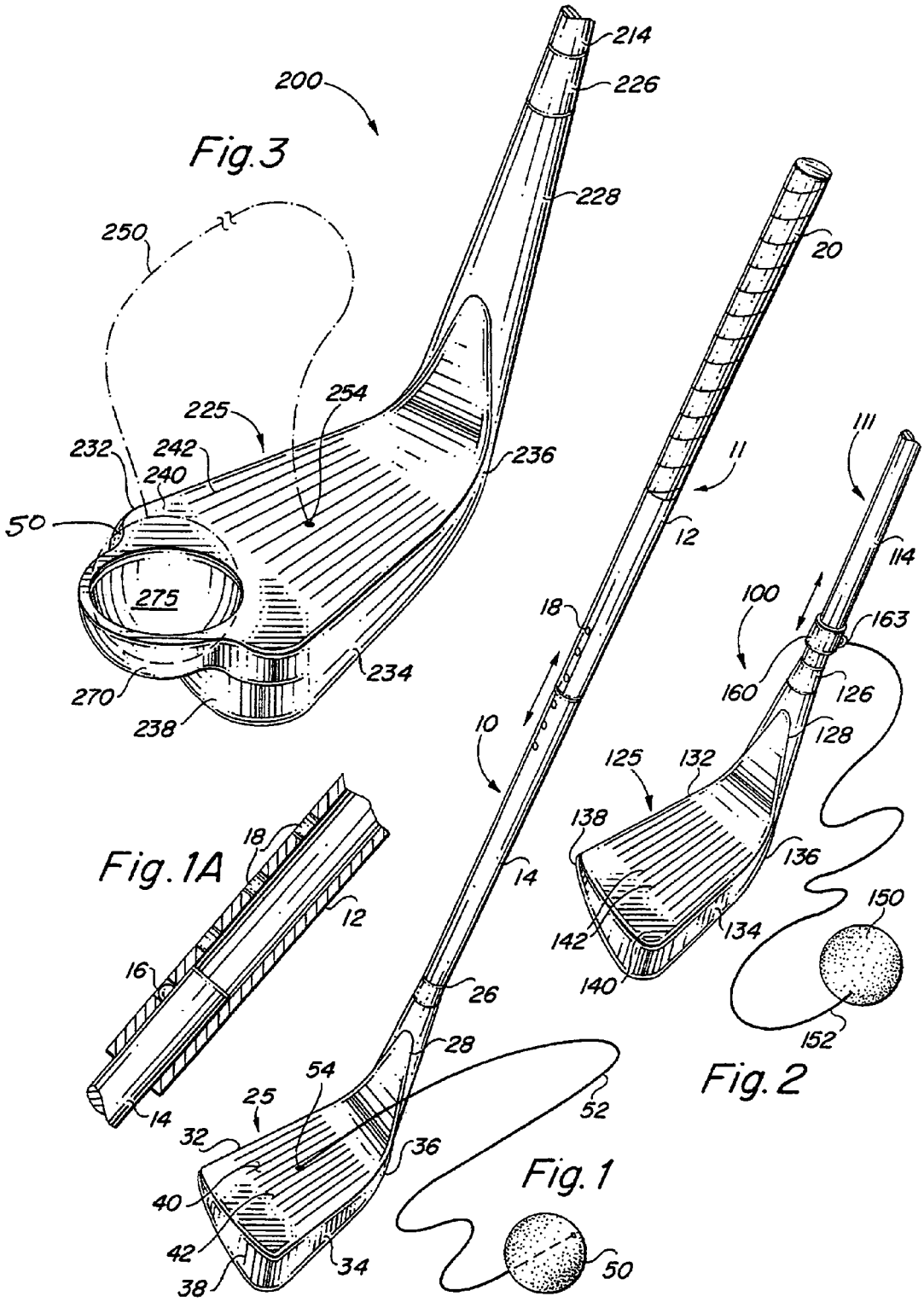
FIG. 1 is a perspective view of a golf club for training, juggling or tapping of the golf ball.
FIG. 1A is a detailed view of a portion of the shaft of the drive shown in FIG. 1 showing the telescopic connection between the upper and lower sections of the shaft.
FIG. 2 is a perspective view of the lower end of an alternate embodiment of the training device according to the present invention.
FIG. 3 is a perspective view of the lower end of yet another training device according to the present invention.

Referring to the drawings, FIG. 1 is a perspective of one embodiment of the training device according to the present invention and is generally designated by the numeral 10. The training device 10 has an elongate shaft 11 having an upper section 12 and a lower section 14. The lower section 14 is telescopically received within the lower end of the upper section 12 as best seen in FIG. 1A. Thus, the overall length of the shaft can be adjusted aligning the spring-loaded detent ball 16 which is located on the upper end of the lower section with a selected one of the bores 18 aligned in the upper shaft section. To reposition the upper and lower, the user will simply apply a manual force to the detent ball 16 which will allow the upper and lower shaft sections to telescopically slide relative to one another. The shafts can then be repositioned to adjust the overall shaft length to the desired size.

The upper end of the upper shaft section 12 carries a grip 20 which may be of a conventional golf club grip material such as a wrap of leather, a rubber or other material. Upper and lower shaft sections 12 and 14 can be fabricated from suitable materials such as steel, carbon fiber or a tubular plastic. Golf club head 25 is secured to the lower end of lower shaft 14 and is received in a socket 26 at hosel section 28. The training club golf head 25 has the general shape and appearance of a conventional golf club head having a top 32, a sole 34, a heel section 36 and a toe 38. The face 40 is provided with a plurality of spaced-apart, parallel grooves 42. Preferably the golf club head is configured with its face having a loft angle relative to a shaft similar to that of or greater than the loft of a conventional pitching wedge which is 56°.

The head of the golf training device can be fabricated from various materials and is preferably a metal or plastic having the weight conforming to the weight of a conventional wedge. If fabricated from plastic, it is preferable that the face 40 of the club head have a metal insert so as to provide the rebound characteristics of a metal golf club.

The device includes a ball 50 which may be a conventional golf ball, but for training purposes, it is preferred that it is a ball conforming in diameter of a conventional golf ball and having greater resilience. For this purpose, the ball may be a relatively soft rubber or a plastic shell with perforations such as a wiffle ball. The ball 50 is attached to the training device by a tether 52. The tether 52 is a flexible cord or string which extends through an aperture 54 in the center of the face of the club. The overall length may be adjusted by tying off the end of the tether to a desired length at the rear of the golf club head.

In use, the individual will first adjust the shaft 11 to the desired length. Initially, a shorter shaft is preferred and the user may also prefer to grip the training device along the lower section 12 of the shaft. The length of the tether 52 is suitably adjusted and for beginners a tether length in the range of 12" to 18" is preferred. The user will then hold the ball a few inches over the club head face 40 and drop the ball on to the face and will try to maintain the face of the training device in a generally horizontal position. The resilient ball 50 is more forgiving than a conventional golf ball and will not rebound with the energy of a conventional golf ball. If ball 50 is mistruck or bobbled, the tether will serve to keep the ball close to the training device so that the user may more easily recover the ball and resume practicing. Once the user has learned the basic skills and becomes proficient using the training device 10, the user may then continue practicing using a conventional golf club and ball.

FIG. 2 shows another embodiment of the invention which is generally designated by the numeral 100. The training device 100 has a shaft 111 which may be of a fixed length or may be adjustable, as has been previously described with reference to FIGS. 1 and 1A. The shaft 111 has a lower section 114 which is received within the socket 126 of hosel 128. The head 125 of the training device 100 also, as has been described with reference to FIG. 1, having a heel 136, a toe 138, an upper edge 132 and a lower edge or sole 134. The face 140 of the club head is provided with a plurality of grooves 142 for control.

In this embodiment, a ball 150, such as a resilient rubber ball or a wiffle ball, is attached to the training device by a tether 152. The tether 152 is attached to the club at a sleeve 160 which is slidable along the lower end of shaft section 114. The sleeve has a loop 163 to which the tether can be adjustably secured. Preferably, the sleeve 160 frictionally engages the shaft section 114 so that the sleeve may be positioned at a selected location along the lower end of the shaft.

The practice routine is as previously described. The user can adjust the length of the tether 152 and the position of the tether sleeve 160 along the shaft in accordance with the personal preferences and skill level of the user.

FIG. 3 shows yet another embodiment of the training device of the present invention which is designated by the numeral 200. The training device 200, again, ha shaft having an upper shaft section (not shown) and a lower shaft section 214. The lower shaft section 214 is received within the socket 226 of a hosel 228. The head 225 of the training device 200 is again configured similar to the shape of a conventional golf club head such as a pitching wedge having a heel 236, a sole 234, a top edge 232 and toe 238. The face 240 of the club head is again provided with a plurality of spaced-apart, generally parallel grooves 242.

In this embodiment, the toe 238 of the head of the training device has a projection 270 which defines a generally upwardly opening, semi-spherical cup 275. The cup 275 is dimensioned so that a ball, either a conventional golf ball or practice ball such as ball 50, shown in broken lines, may be seated within the cup. The ball may be tethered by a tether 250 to the training device either at a central location 254 on the face of the club head or to another location such as on the shaft as described with reference to FIG. 2. With this embodiment, the user will begin the practice session by placing the ball in the cup 275 while holding the base of the training device in a generally horizontal position. The juggling will begin by pulling or tilting the face 240 to cause the ball to become dislodged from the cup 275 and moving the face 240 to a position to contact the ball 50.

Figures 4, 5:
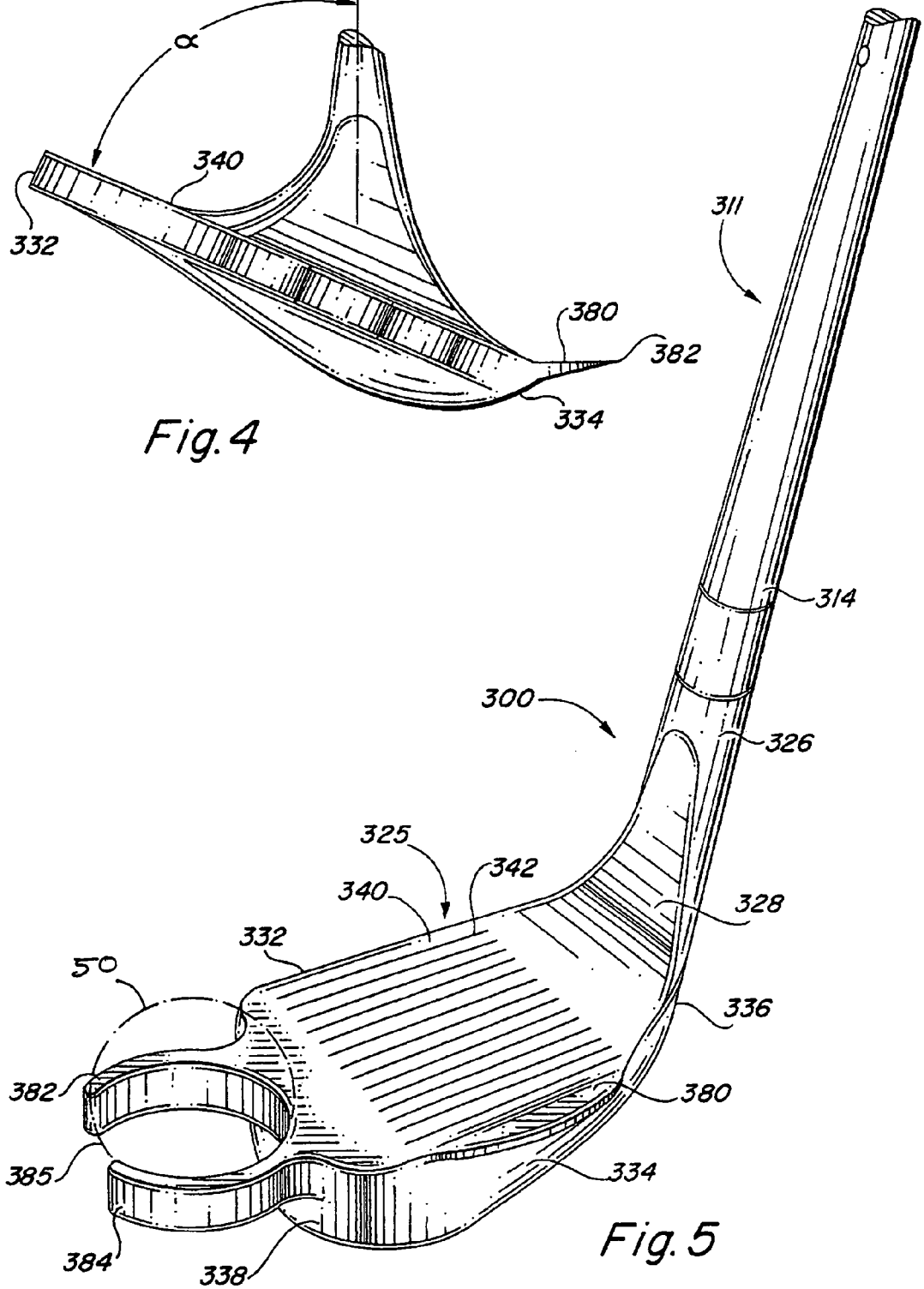
FIG. 4 is a view of the lower end of yet another embodiment of the present invention as viewed from the front or toe of the club.
FIG. 5 is a perspective view of the training device shown in FIG. 4.

FIGS. 4 and 5 show yet another embodiment of the training device of the present invention. This embodiment is generally designated by the numeral 300 and, again, is provided with a shaft 311 having a lower section 314 which is received within the socket 326 of hosel 328. Hosel 328 is an integral part of the head 325 which is again configured similar to a conventional wedge having a top surface 332, lower edge or sole 334, heel 336 and toe 338. The club has a face 340, again with a plurality of generally parallel grooves 342 to provide control. A lip 380, which is generally semi-circular, extends from the lower edge 334. The lip 380 is an extension of the face 340 and is slightly inclined upwardly as best seen in FIG. 4. Lip 380 tapers to an edge 382.

The toe 338 of the training device is provided with a pair of arms 382 and 384, each of which are arcuate and opening 385 is defined between the distal ends of the arms. The arcuate arms are sized to receive and cradle a golf ball as shown in FIG. 5 in broken lines. The ball may be a conventional golf ball or other ball such as ball 50 conforming to the size of a conventional golf ball.

The training device of FIGS. 4 and 5 may be used to practice and develop juggling or tapping skills in the manner as has been previously described. However, the training device of FIGS. 4 and 5 provides features which will allow the user to more easily retrieve an errant ball that has been mistruck. The ball can be retrieved from a surface, such as the ground, by placing the lip 380 beneath the ball causing the ball to roll back on to the face of the club so that the practice routine may be resumed.

In a similar manner, the user may use the arcuate arms 382 and 384 to engage the ball on a surface such as on grass or on the ground. The club can be manipulated to urge the arms under the ball so that the ball will be retrieved by the arms and assume a nesting position in the opening 385 as shown in FIG. 5. Again, the practice routine can be resumed by manipulating the club to cause the ball to be elevated from the club face so the juggling or bouncing practice routine may be resumed.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. A training device for practicing juggling a ball on the face of a golf club, said device comprising:

(a) a shaft having an upper end and a lower end;

(b) a head having a heel, toe, upper and lower edges and a hosel, said head defining a generally planar face extending continuously between said edges and from the heel to the toe, said head attached to the lower end of the shaft at said hosel with the face having a loft angle relative to the shaft; and (c) a generally circular receptacle extending outwardly from the toe and having an upper edge generally aligned with the plane of said face, said receptacle dimensioned to nestably receive a portion of a ball conforming to the size of a regulation golf ball with a portion of the nestably received ball extending above the face.

2. The training device of claim 1 including a ball tethered to said device.

3. The training device of claim 1 further including a lip projecting downwardly from the lower edge of the head.

4. The training device of claim 1 wherein said receptacle is generally semi-spherical.

5. The training device of claim 1 wherein said receptacle has a pair of opposed arcuate arms.

* * * * *